US006474057B2

(12) United States Patent
Bertini et al.

(10) Patent No.: US 6,474,057 B2
(45) Date of Patent: Nov. 5, 2002

(54) WIRE ROPE LUBRICATION

(75) Inventors: Glen J. Bertini, Tacoma; Glenn S. Jessen, Everett, both of WA (US)

(73) Assignee: Utilx Corporation, Kent, WA (US)

( * ) Notice: Subject to any disclaimer, the term of this patent is extended or adjusted under 35 U.S.C. 154(b) by 0 days.

(21) Appl. No.: 10/112,352

(22) Filed: Mar. 28, 2002

(65) Prior Publication Data

US 2002/0095929 A1 Jul. 25, 2002

Related U.S. Application Data

(60) Division of application No. 09/870,413, filed on May 29, 2001, which is a continuation-in-part of application No. 09/546,045, filed on Apr. 10, 2000, now abandoned, which is a continuation-in-part of application No. 09/441,407, filed on Nov. 16, 1999, now Pat. No. 6,327,841.

(51) Int. Cl.[7] ..... D02G 3/02
(52) U.S. Cl. ..... 57/210
(58) Field of Search ..... 57/210, 212, 213, 57/216, 221, 222, 223; 19/3

(56) References Cited

U.S. PATENT DOCUMENTS

| | | | |
|---|---|---|---|
| 2,162,130 | A | 6/1939 | Somerville |
| 4,344,278 | A | 8/1982 | Jamison et al. |
| 4,635,432 | A | 1/1987 | Wheeler |
| 4,845,309 | A | 7/1989 | Vincent et al. |
| 5,662,189 | A | 9/1997 | Anderson et al. |

FOREIGN PATENT DOCUMENTS

| | | |
|---|---|---|
| DE | 604480 | * 10/1934 |

* cited by examiner

*Primary Examiner*—Danny Worrell
*Assistant Examiner*—Shaun R Hurley
(74) *Attorney, Agent, or Firm*—Christensen O'Connor Johnson Kindness PLLC

(57) ABSTRACT

A wire rope (10) includes a plurality of strands (12). The strands are formed from individual wires or filaments (14). The strands are wound about a central axis. A conduit (16) also extends along said central axis. The conduit has walls that are foraminous and permit radial flow of a lubricant. The lubricating compound is injected into the channel (18) defined by the conduit. The lubricating material migrates through the orifices in the conduit wall and radially outwardly therefrom.

8 Claims, 9 Drawing Sheets

WIRE ROPE LUBRICATION

This application is a divisional of prior application Ser. No. 09/870,413, filed May 29, 2001, which is a Continuation-In-Part of U.S. patent application Ser. No. 09/546,045, filed Apr. 10, 2000, now abandoned, which is a Continuation-In-Part of U.S. patent application Ser. No. 09/441,407, filed Nov. 16, 1999, the disclosures of which are hereby expressly incorporated by reference.

FIELD OF THE INVENTION

This invention relates to wire ropes, and more particularly, to a method and an apparatus for lubricating wire ropes.

BACKGROUND OF THE INVENTION

Wire ropes traditionally comprise a plurality of wires or filaments that are wound or twisted into multi-wire strands, which in turn are twisted about each other to form a wire rope. Wire ropes are used in a variety of applications including drag lines, elevators, bridges, hoists, and marine tow ropes. Wire ropes are stressed and relaxed numerous times during their life cycle. They also undergo frictional stress to a certain degree in straight pulls but more so when they traverse a sheave or are wound onto a drum. The wires and strands are thus caused to move in relation to each other causing wear in the rope. Wire ropes are lubricated to promote unrestricted movement of the rope, minimal fatigue and frictional wear. Lubrication also provides protection against rust and corrosion.

Wire ropes are typically lubricated from the outside with a lubricating material such as an oil or a grease. It is common to lubricate a wire rope by dripping oil on it or pulling it through an oil bath. Thick coats of grease have also been applied to wire ropes from the outside with the hope that the grease will penetrate into the interior of the rope. These methods of lubrication are not long-term solutions because the lubricants evaporate or are wiped away during normal use.

In recent years, wire rope manufacturers have tried other methods to lubricate wire ropes. For example, a solid core made of a porous polymer, or other absorbent material, has been positioned in a wire rope. The solid core is made of a polymer and a lubricant. When the core is stressed, lubricating material is squeezed from the solid core. These lubrication techniques are time limited because of the finite lubricant supply in the cores. Attempts have been made to replenish the lubricant in rope cores by pouring additional lubricant over the rope or pulling it through a bath. These methods have not proven to extend the life of a wire rope for any appreciable amount of time.

SUMMARY OF THE INVENTION

The present invention solves the shortcomings of the prior art methods for lubricating wire ropes by providing a wire rope having one or more channels or conduits running in the direction of the axis of the wire rope. The conduits are capable of receiving and carrying a lubricant or other performance-enhancing material. A lubricant, for example, is injected axially along the channel. The lubricant diffuses out of the conduit and into the regions between the filaments and the strands comprising the wire rope to lubricate the wire rope during its use cycle. In a preferred embodiment, a lubricated wire rope includes a plurality of load-bearing strands wrapped about a central elongated axis. A first conduit is physically disposed within the plurality of load-bearing strands. The first conduit is adapted to permit a lubricating compound to flow therethrough. The conduit is permeable to the lubricating compound to permit a predetermined portion of the compound to diffuse through the first conduit into contact with the strands and the filaments making up the strands, thereby lubricating them.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
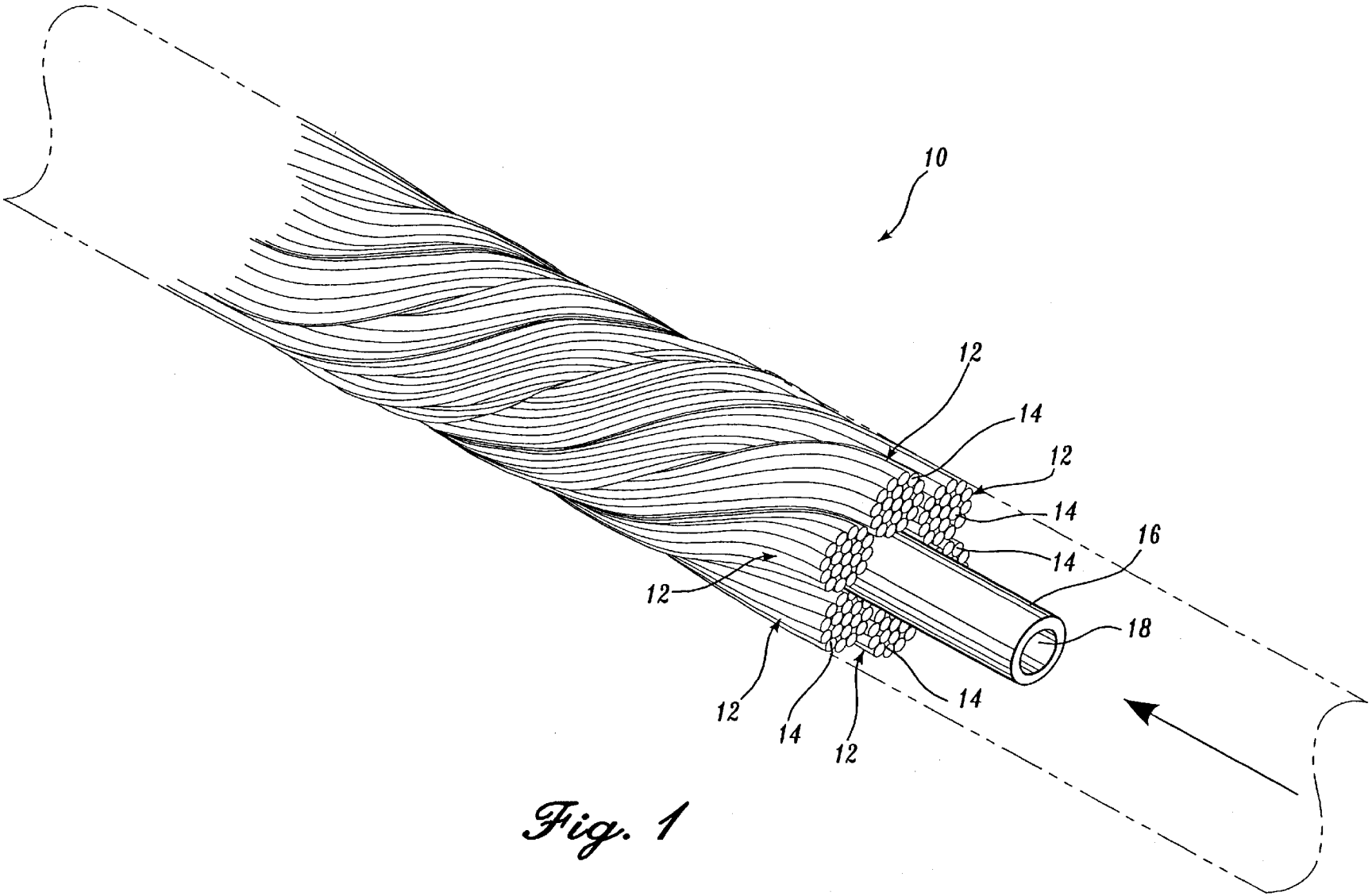
FIG. 1 is a perspective view of a wire rope constructed in accordance with one embodiment of the present invention.

Referring to FIG. 1, a wire rope 10 includes a plurality of load-bearing strands 12 that are wound about each other and a central axis to form a load-bearing wire rope 10. In a typical configuration, each of the strands is composed of a plurality of wires or filaments 14. These wires or filaments are first wound about each other to form a strand before the wire rope 10 is manufactured from a plurality of strands. As used herein the term strand refers both to a structure comprising a single wire or filament or multiple wires or filaments.

In accordance with the preferred embodiment of the present invention, a flexible conduit 16 is positioned along the axis of the wire rope 10. The conduit 16 has a central channel 18 for receiving a lubricating compound. In this embodiment, the conduit 16 runs along the axis of the wire rope 10 and the strands 12 are wound about the conduit 16.

The conduit 16 can be made of polyethylene, nylon, aromatic polyamides (e.g., Kevlar®), polytetrafluoroethylene, or other suitable polymeric materials. The conduit 16 is manufactured so that it is flexible and chemically permeable to the performance-enhancing compound. Chemically permeable materials permit the passage of liquids, gas, molecules, or ions through intermolecular spaces. The use of such materials allows one to control the rate of permeation by the choice of materials (tube and fluid), thereby assuring a consistent penetration along the length of the conduit 16, especially for an extremely low mass flux.

Thus the performance-enhancing compound can diffuse radially outwardly through the conduit walls so that the lubricating material can come into contact with the strands 12. The conduit can also be made of other perforated or foraminous materials, for example, sintered metals. A foraminous conduit is one with a plurality of small openings or orifices.

The degree of permeability of the conduit 16 can be altered by one of ordinary skill in the manufacture of polymeric material to provide a rate of permeability that will satisfy the lubrication requirements of wire ropes in different applications. The rate of diffusion of the performance-enhancing compound through the conduit walls can easily be regulated by one of ordinary skill by selectively choosing or altering the molecular size or structure of the lubricating compound (thus altering the diffusively or solubility), the thickness of the conduit, the pressure at which the fluid is delivered, and finally the operating temperature of the wire rope.

The conduit 16 must have sufficient physical strength to be incorporated in the wire rope 10 and adequate thermal properties for use in maximum and minimum thermal environments in which the wire rope 10 may be used. Preferably, the conduit 16 has the thinnest wall possible to allow lubricating compound storage and free flow. The conduit 16 must also be capable of withstanding the normal operating temperatures of the wire rope. As a non-limiting example, the wall thickness of the conduit 16 is suitably between 1/64 and 1/32 of an inch. Although a cylindrical or nearly cylindrical geometry is the preferred geometry for the conduit 16, it should be apparent that other hollow geometries are also included within the scope of the present invention.

A wide variety of performance-enhancing materials can be injected through the conduit 16. These include but are not limited to lubricants, corrosion inhibitors, antioxidants, UV stabilizers, water repellents, water-proofers, water scavengers, ion scavengers, and other performance improving materials and compounds. One of ordinary skill, once understanding the utility of the invention, will readily be able to inject a wide variety of other performance-enhancing materials or compounds in accordance with the present invention.

The lubricating compounds especially useful in accordance with the present invention include a wide variety of existing lubricants that can flow through the channel 18 and diffuse through the walls of the conduit 16. Typical petroleum-based lubricants can be used with porous or foraminous conduits. Monomeric, oligmeric and low molecular weight polymeric silanes and siloxanes can also be used and have the capability of diffusing through the walls of selected solid polymeric tubes.

Where the conduit 16 is not foraminous or sintered, the lubricating materials must be of sufficiently low molecular weight to permeate through the polymeric conduit wall. Low molecular weight lubricants suffer from a short-lived presence on the surfaces to be lubricated due to their volatility and rapid surface transport resulting from their low viscosity. The present invention involves the use of an organosilicone fluid, which comprises silanes of the general formula $$(RO)_x SiR'_y R''_z R'''_{(4-x-y-z)}$$

where R denotes an aliphatic, aromatic, or an arene radical with 1 to 12 carbon atoms, preferably 1 to 2 carbon atoms; R' denotes an aliphatic, aromatic, or an arene radical with 0 to 12 carbon atoms; R" denotes an aliphatic, aromatic, or an arene radical with 0 to 12 carbon atoms; and R'" denotes an aliphatic, aromatic, or an arene radical with 0 to 12 carbon atoms and mixtures and partial hydrolysates thereof. It should be understood that, within the scope of this invention, when carbon atoms =0, R', R", and R'" are atoms, which may have a valance of −1, such as hydrogen, florine, chlorine, and bromine.

Still referring to the formula above, the subscript "x" is between 1 to 4, but preferably 2. The subscripts "y" and "z" are from 0 to 4, but the sum of x, y, z, and 4-x-y-z must be 4. The aliphatic, aromatic, or arene radicals may be substituted with halogens, hydroxy or other radicals without departing from the spirit of this invention. Such substitutions can be used to control the permeation rate, and add functionality such as UV stabilization or antioxidation or other desirable properties to extend the life of the wire rope. Examples of materials which are encompassed within this general formula are dimethyldimethoxysilane, dimethyldiethoxysilane, phenylmethyldimethoxysilane, naphthylmethyldiethoxysilane, methyltrimethoxysilane, and bromophenylethyldiethoxysilane.

The alkoxy functionality and especially dialkoxy functionality (x=2) designated in the general formula above as $$(RO)_x$$

solves the problem of the lubricant having too high a volatility and too low a viscosity. This alkoxy functionality provides for the hydrolysis and condensation reaction with water, which is ubiquitous in either the liquid or vapor state in the environments where the wire ropes are used, such that longer chain oligomers or polymers are formed shortly after the supplied lubricant diffuses out of the conduit 16. A mixture of compounds primarily made up on a molar basis with x=2 and a smaller molar amount with x=1 can be utilized to end-block the growing oligomer chain to prevent excess viscosity of the fully hydrolyzed material. For example, if the molar ratio of x=2 to x=1 were 50 to 1, the resulting siloxane mixture would have an average degree of polymerization of 25.

Alternatively, large viscosity increases could be encouraged where the application requires a higher viscosity, such as where the operating temperature is very high, by including a small molar ratio in the mixture of materials in which x=3 or x=4. Where alkoxy functionality exceeds 2, cross-linking of oligomer chains can yield gel-like or grease-like consistencies. For example, a mixture of 75–99% by weight of dimethyldimethoxysilane together with 1–25% by weight of methyltrimethoxysilane would result in lubricants with cross-linked chain structure and rheologies similar to greases used today in the wire rope industry. Thus, mixtures can be made of materials where the primary component has x=2, and smaller amounts of x=1 and/or x=3 or 4 can be blended to yield any desired rheology.

Another way to control the speed and degree of polymerization is to include any of several hydrolysis and/or condensation catalysts known in the art on the surface of the conduit 16, on the surface of the wire rope stands, or in the mixture of lubricant greases 73 which are included in the itersticial spaces of the strands during the manufacture of the rope, as seen in FIG. 9. A catalyst may be chosen from a group that includes titanates, such as tetraisopropyltitanate.

Other low viscosity, low molecular weight organic lubricants and other synthetic lubricants known in the art can also be used.

It is contemplated that during manufacture and use, it is possible that the conduit 16 can be pinched or crushed. One way to maintain an open channel 18 in a conduit 16 is to introduce a fluid into the tube under pressure during the manufacturing process. This would balance the inward pressure on the central conduit during normal strand compression procedures and prevent the conduit from deforming or collapsing. This technique would also prevent collapse of the tube during compacting or swaging operations.

Figure 2A:
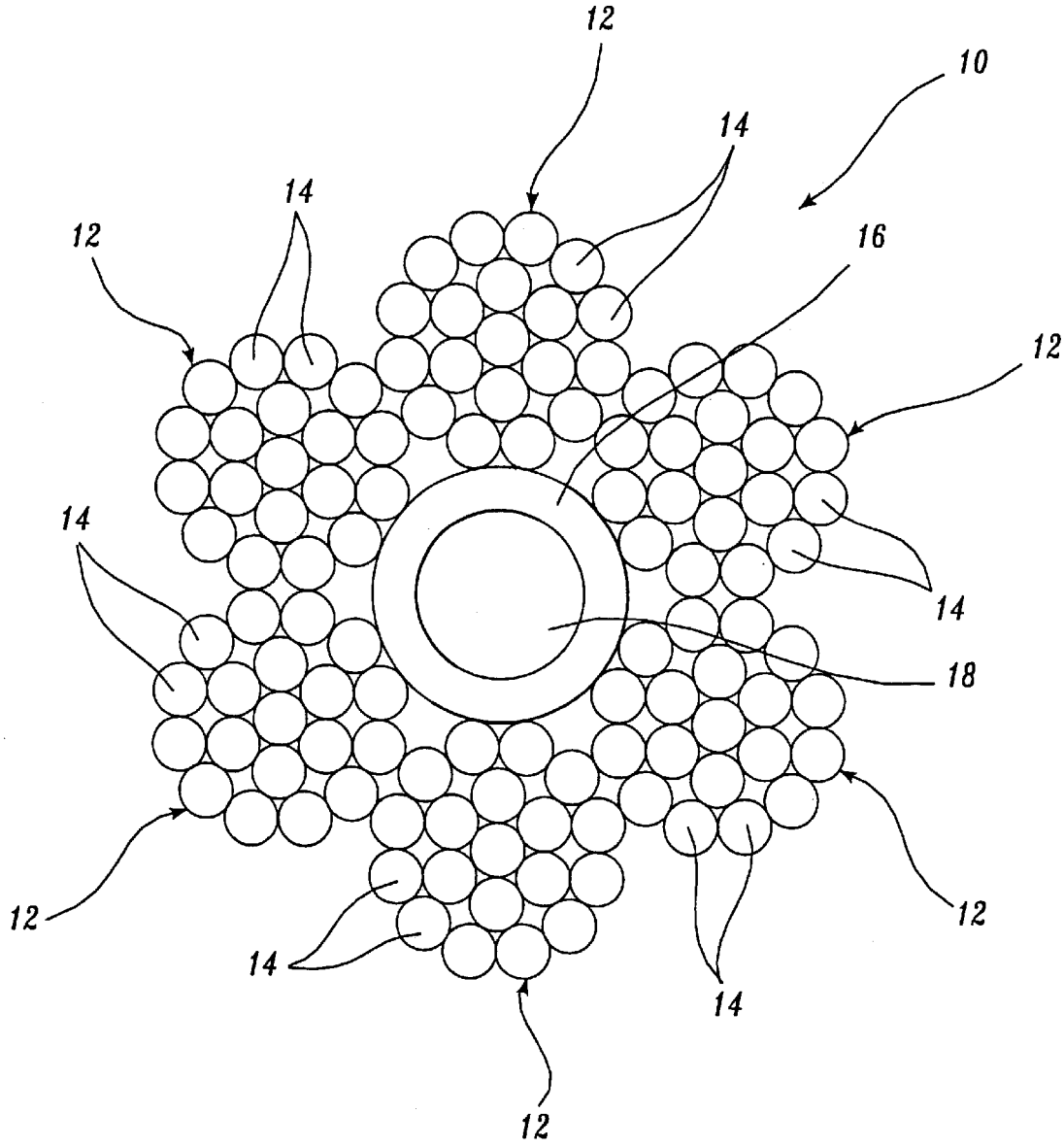
FIG. 2A is cross-section of the wire rope of FIG. 1.
Figure 2B:
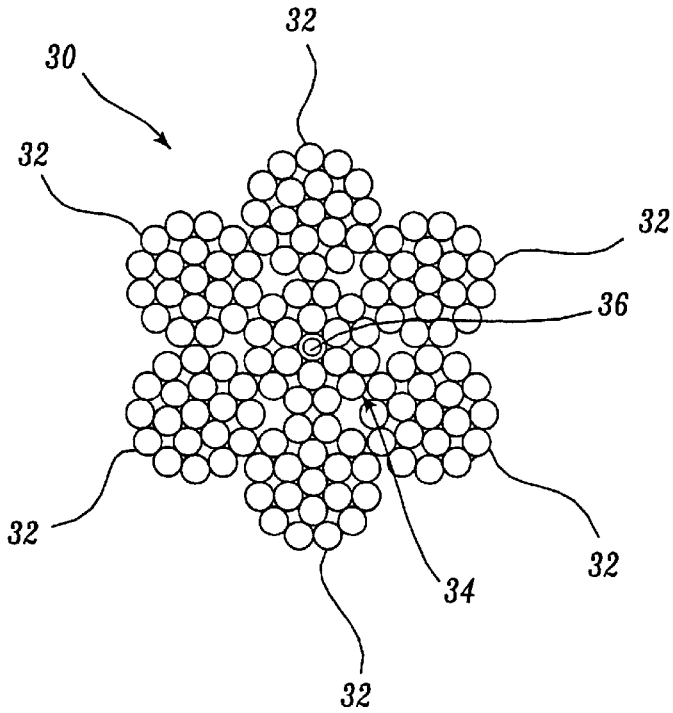
FIGS. 2B–2E are alternate embodiments of that shown and described in conjunction with FIG. 2A.

Referring now to FIG. 2B, the first alternate embodiment of a wire rope 30 incorporates the concepts of the present invention. The wire rope 30 comprises six strands 32 wound about a central core strand 34. Strand 34 is comprised of a plurality of individual wires or filaments that are wound about a central tube or conduit 36. The conduit 36 has a central channel into which performance-enhancing materials or compounds can be injected. The performance-enhancing materials can migrate through the conduit 36 radially outwardly into first the central strand 34 and then the exterior strands 32.

Figure 2C:
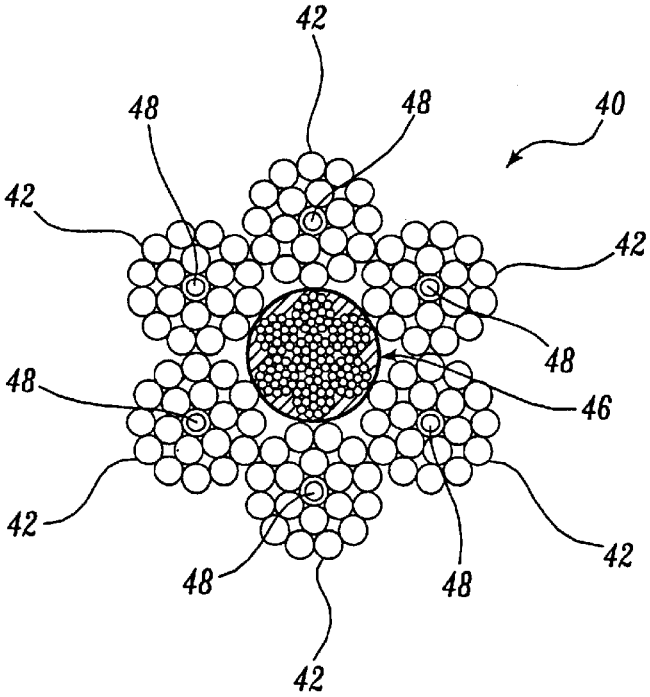

Referring to FIG. 2C, a wire rope 40 comprises six exterior strands 42 wound about a central strand 46. Central strand 46 is in turn comprised of several smaller strands that are encapsulated in a polyethylene jacket. The type of strand and jacket making up the central strand is described in further detail in conjunction with FIGS. 3A–3D. In this embodiment, the six outer strands 42 carry central conduits 48 into which performance-enhancing fluids or materials can be injected. These performance-enhancing materials again migrate outwardly through the wires or filaments comprising the individual strands 42.

Figure 2D:
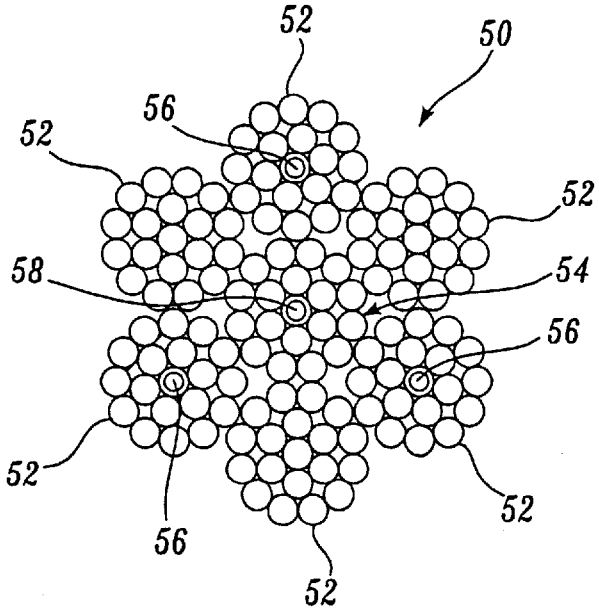

Referring to FIG. 2D, wire rope 50 comprises six outer strands 52 wound about a central core strand 54. Alternate ones of the outer strands 52 are composed of wires wound about a central conduit 56. Central strand 54 similarly carries a central conduit 58. Performance-enhancing materials can be injected into the conduits 56 and 58 in a manner similar to that previously described.

Figure 2E:
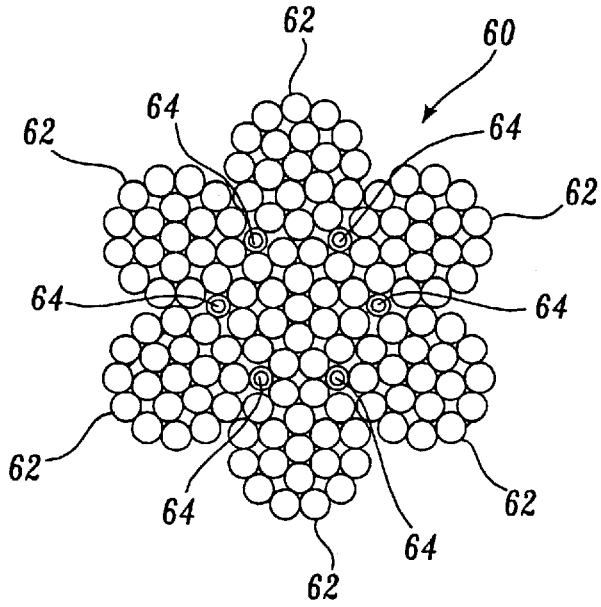

Finally, referring to FIG. 2E, yet another embodiment of a wire rope 60 comprises six outer strands 62 wound about a central core strand 64. In this embodiment, conduits 64 are not positioned within the individual strands but in the triangularly shaped cavities formed between two adjacent outer strands and the inner strand 64. Six of these cavities carry six conduits 64. Again, performance-enhancing materials can be injected into these conduits 64 in a manner similar to that described above.

Figure 3A:
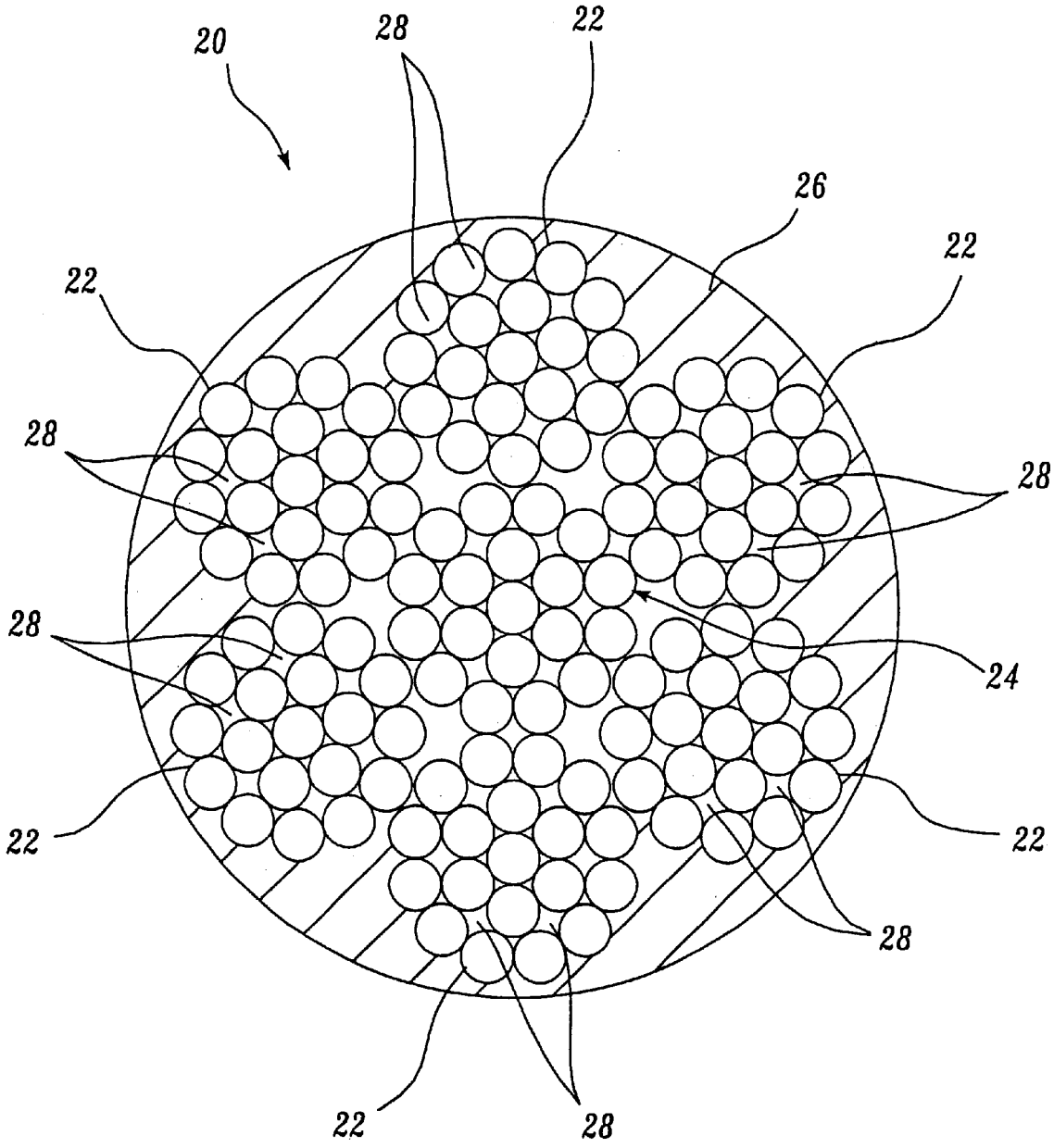
FIG. 3A is a cross-section of an alternate embodiment of the wire rope of FIGS. 1 and 2.

Referring now to FIG. 3A, a cushioned core rope 20 is illustrated. A typical cushioned core rope is manufactured in the same manner as an ordinary wire rope. In this embodiment, the rope comprises strands 22 wound about a central strand 24. A polyethylene jacket 26 is extruded around the entire wire rope. The purpose of the polyethylene jacket is to provide a degree of cushioning and lubrication to the individual strands 22. While the polyethylene jacket is formed about the cushioned core rope 20, care is taken so that the polymeric material does not flow into the interstitial spaces or interstices 28 between the individual filaments of the strands 22. These interstices form a multiplicity of channels that spiral in an axial direction along the entire length of the cushioned core rope 20. In accordance with the present invention, it is possible to inject a performance-enhancing material axially through these interstices 28 and provide additional lubrication to a cushioned core rope.

Figure 3B:
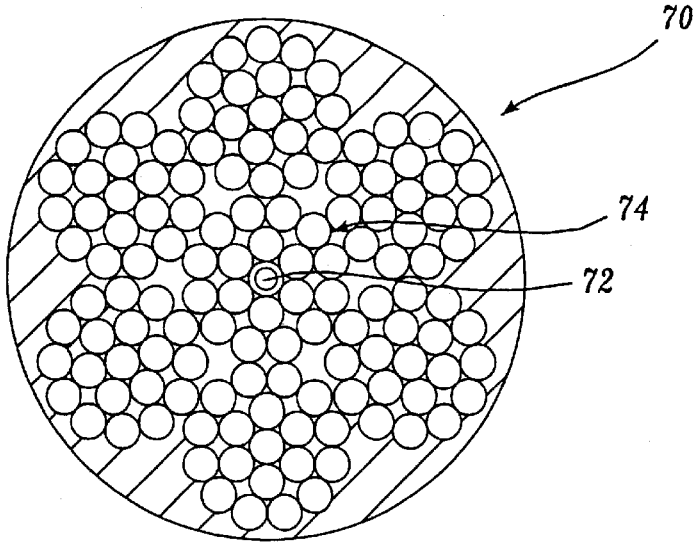
FIGS. 3B–3D are alternate embodiments of that shown in and described in conjunction with FIG. 3A.

Referring now to FIG. 3B, a wire rope 70 of the cushioned core type described in conjunction with FIG. 3A has a central conduit 72 positioned in the central strand 74 of the rope 70. Individual wires of the central strand 74 are wound about the conduit 72. A performance-enhancing material can be injected into the conduit 72 as described above.

Figure 3C:
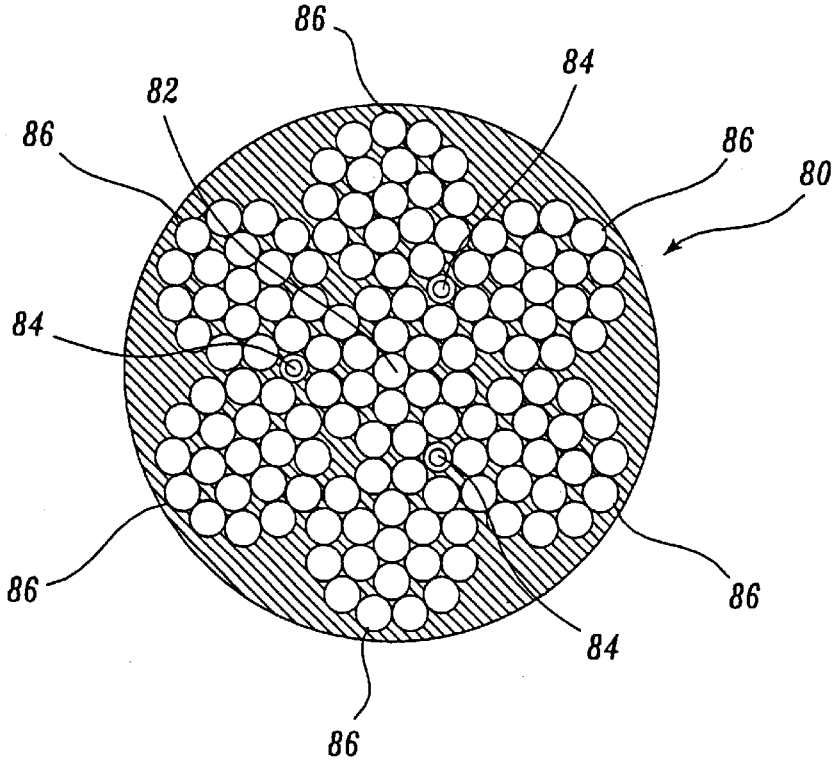

Referring to FIG. 3C, a cushioned core wire rope 80 is similar to that shown in FIG. 3B. This embodiment, however, differs from that of FIG. 3B in that the interstitial spaces between the outer strands 92 and the inner strand 94 are filled with the cushioning material. Additionally, the central conduit 72 is replaced by a wire or filament 82. Conduits 84 are positioned in alternating triangularly shaped regions created between two adjacent exterior strands 86 and central strand 82. In this embodiment, three conduits 84 are employed and positioned in alternating ones of the triangularly shaped regions. Performance-enhancing materials can be injected into these conduits similar to that described above.

Figure 3D:
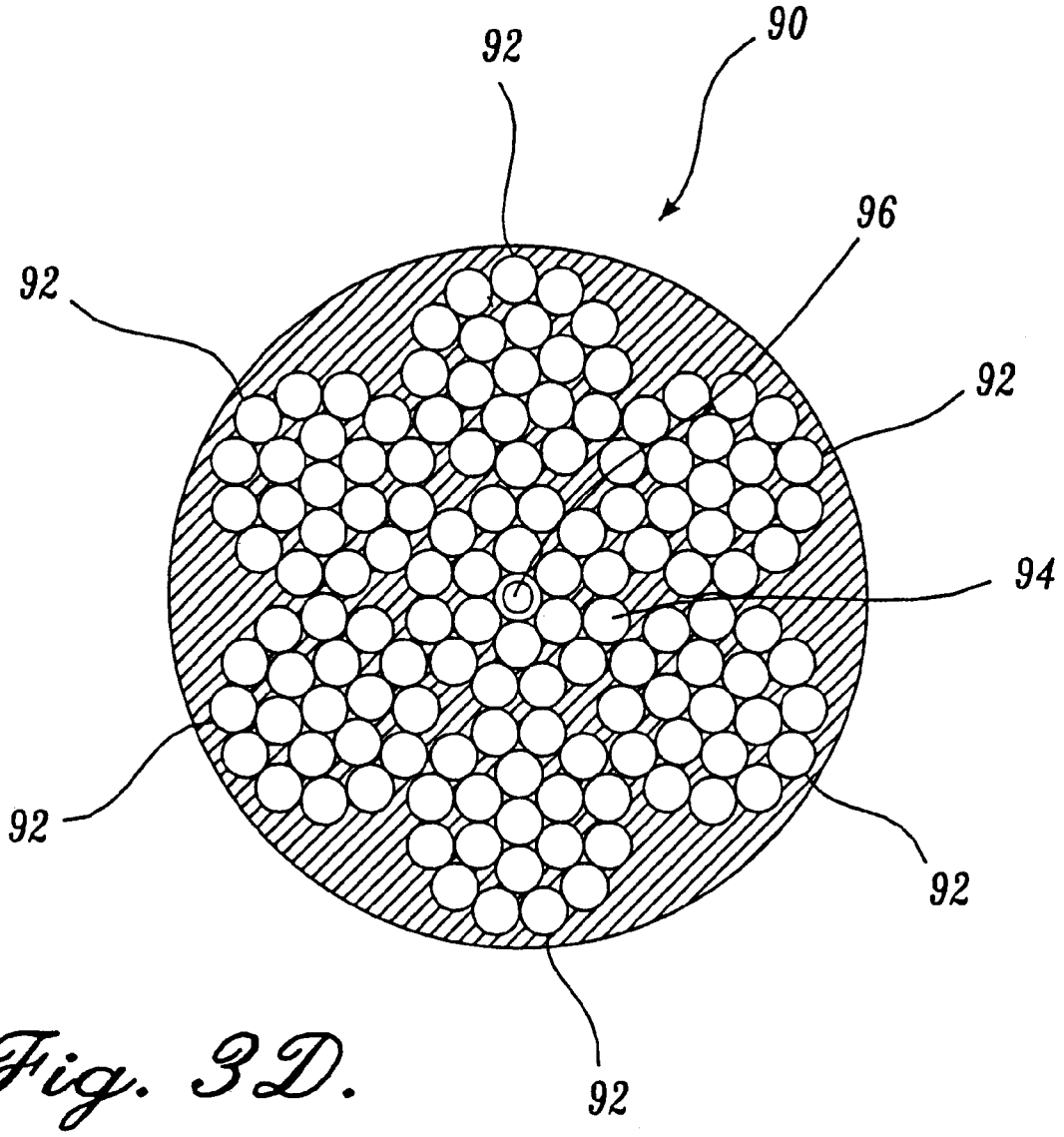

Finally, referring to FIG. 3D, cushioned core rope 90 is similar to that described in conjunction with FIG. 3B above. This embodiment, however, differs from that of FIG. 3B in that the interstitial spaces between the outer strands 92 and the inner strand 94 are filled with the cushioning material. A conduit 96 is positioned in the center of the central strand 94 replacing the central wire during manufacture. A performance-enhancing material can be injected into conduit 96 in the manner similar to that described above.

One of ordinary skill will be able to devise a number of efficient ways to inject material into the channel 18 of the wire rope of FIGS. 1 or 2 or through the interstices 28 of the cushioned core wire rope 20 of FIGS. 3A and 3B. A variety of connecting devices for injecting a fluid into electrical cable are disclosed in co-pending provisional patent application Ser. No. 60/155,279, filed Oct. 11, 1999, attorney docket No. UTLX-1-14551. These connecting devices can easily be adapted for use in conjunction with wire ropes.

Figure 4:
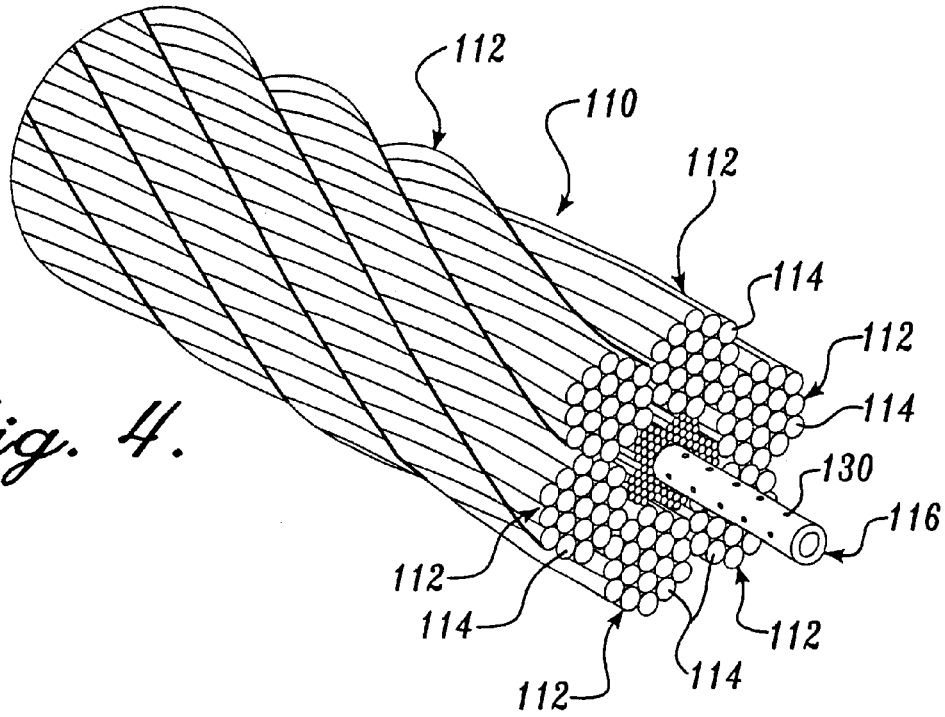
FIG. 4 is an alternate embodiment of the wire rope of FIG. 1 showing a perforated conduit axially disposed within the wire rope.

Referring now to FIG. 4, an alternate embodiment of a wire rope 110 formed in accordance with the present invention is illustrated. The wire rope 110 is identical in materials and operation as the preferred embodiment described above, with the following exception. Instead of a conduit 16, this alternate embodiment includes a perforated conduit 116. The perforated conduit 116 can be made of any suitable material, but a metal or plastic material is preferred. The conduit has a plurality of circular or irregular holes 130 pierced either mechanically or thermally in a regular or irregular pattern. The circular or irregular holes 130 have a minimum diameter, $d_{min}$, which allows lubricating material with a spherical particle that has a slightly smaller diameter than $d_{min}$ to pass through to the wire rope strands 112.

Many wire rope lubricants include solid particles such as but not limited to graphite, molybdenum disulfide, Teflon, and titanium nitride in their formulation. Where the use of these solid lubricants are desired in combination with a foraminous conduit, the majority of the solid particles must have an average diameter smaller then $d_{min}$. Because $d_{min}$ will change proportionally with an increase in the wire rope tension, this change of $d_{min}$ should be accounted for when choosing a lubricant. In addition to lubricant distribution based upon particles passing through $d_{min}$, the rheology of the lubricant can be varied to accommodate the geometry of the conduit. The rheology should be chosen to optimize the performance and economy of the lubricating system.

Lubricants with a yield shear greater than zero, such as Bingham plastics and thixotropic fluids, are useful when combined with a foraminous conduit. A lubricant with a radial flow resistance greater than the axial flow resistance will provide a more uniform lubrication along the length of the wire rope. Ideally, the radial flow rate would equal zero until a critical pressure was reached along the entire length of the wire rope that exceeded the yield shear of the lubricant system even if the conduit had a considerable static head differential along its length (for example, a vertical mine-shaft application). Although a compound having a yield shear greater than zero is preferred, other compounds, such as a compound with a yield shear equal to zero, are also within the scope of the present invention. A non-limiting example of a compound having a yield shear equal to zero is motor oil.

Figure 5:
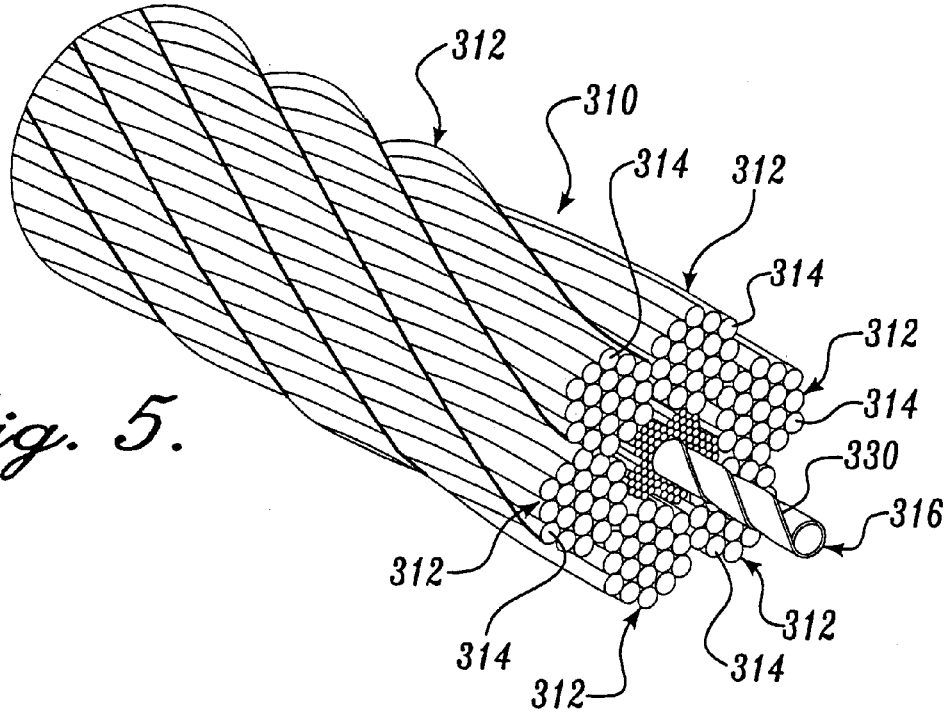
FIG. 5 is an alternate embodiment of the wire rope of FIG. 4 showing a tube having a longitudinally extending slot axially disposed within the wire rope.
Figure 7:
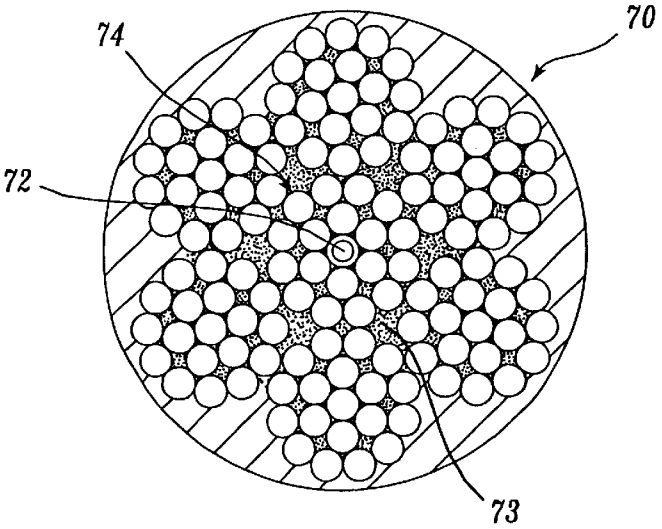
FIG. 7 is an alternate embodiment of a wire rope of FIG. 3B showing a catalyst disposed within the interstices of the wire rope.

Referring now to FIG. 5, another alternate embodiment of a wire rope 310 formed in accordance with the present invention will now be described in greater detail. The wire rope 310 is identical in materials and operation as the alternate embodiment wire rope described above, with the following exception. The wire rope 310 includes a tube 316 having a longitudinally extending seam 330.

The tube 316 is formed from a metal, plastic, elastomeric, or laminate strip that is wound in an overlapping helix. Lubricant passes through the seam 330 between overlapping sections and travels a distance equal to the width of the strip multiplied by the percentage of overlap. As a non-limiting example, if the tube 316 were made from a one inch strip and the overlap is 40%, lubricant exudes between the helixes for a distance of 0.4 inches before exiting the tube. The overlap may vary from 0% to 99%, but the preferred embodiment would be from 20% to 70%. A 50% overlapping helix, for example, can be stretched almost 100% before there would be any gaps between adjacent helixes.

The tube 316 can be varied to accommodate many various lubrication particle sizes and the desired lubrication rheology. The following properties of the tube 316 can be adjusted: strip width; overlap of the helix; tightness and tolerances of the overlap; nature of the interface between the overlapping helixes; mechanical properties of the materials; and interaction of the conduit with the geometry of the surrounding wire rope. The tightness and the surface tolerances of the overlap affect the exudation rate because the microscopic flow paths between two plates effectively vary the minimum distance therebetween. For example, a rough surface would allow more flow than a smooth surface. Also, the seam 330 could be multiple seams, a straight seam, or a combination of straight and overlapping helix seams.

Figure 6:
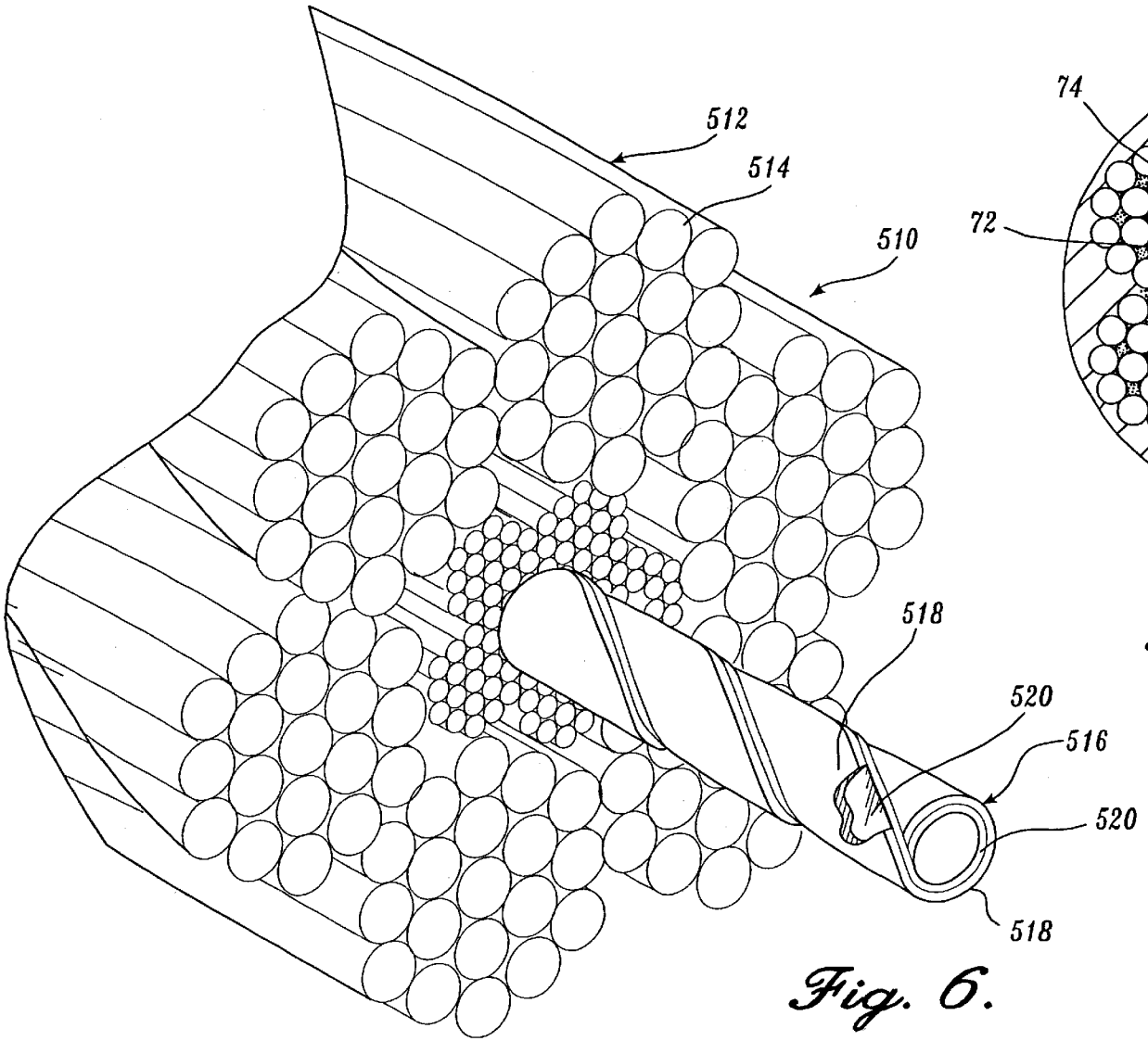
FIG. 6 is an alternate embodiment of a wire rope of FIG. 5 showing a multi-ply tube axially disposed within the wire rope.

Now referring to FIG. 6, another alternate embodiment of a wire rope 510 formed in accordance with the present invention will now be described in greater detail. The wire rope 510 is identical in materials and operation as the alternate embodiment wire rope 310 described above, with the following exception. The wire rope 510 includes a centrally located tube 516 having a longitudinally extending seam that includes a layer 518 and a metallic base 520. The layer 518 may be an elastomeric material and is suitably attached to one side of the base 520. Although the base 520 is coated on one side with the layer 518, other embodiments, such as having a layer 518 on both sides of the base 520, are also within the scope of the present invention.

As noted above, the nature of the interface between overlapping helixes can also be used to control exudation properties. As a non-limiting example, a tube having an overlapping seam made from a metal/elastomeric laminate would restrict fluid flow greater than a tube that had a metal to metal interface between the overlaps. Both the mechanical properties of the material and the interaction of the tube with the wire rope strands affect the radial flow of the lubricant as the internal pressure of the lubricant in the conduit increases. Materials having a greater elasticity will be more apt to deform as the internal pressure increases. As the conduit begins to deform, the layout of the wire rope strands can affect the radial flow of the lubricant.

For a non-limiting example, if the lay of the overlapping seam were right handed and the strip width and the overlap were chosen to match the lay angle of the overlaying wire strands and the strands were also right handed, an increase in internal pressure would deform the conduit and allow a greater lubricant flow. By changing the lay of the conduit from right handed to left handed, the overlaying stands would restrict the deformation of the overlapping conduit, and thus reduce the radial flow through a tube with the same mechanical properties.

While the preferred embodiments of the invention have been illustrated and described, it will be appreciated that various changes can be made thereto without departing from the spirit and scope of the invention. As a non-limiting example, such ropes may be formed from strands of synthetic polymeric materials, such as nylon or Kevlar®. In still yet other embodiments, the ropes may be made from strands of natural material, such as cotton or hemp. As a result, although the foregoing descriptions have been described as being applicable to wire ropes, it should be apparent that other types of ropes made from strands of synthetic or natural materials are also within the scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A wire rope comprising:

(a) a plurality of load bearing strands wrapped about a central axis and having a plurality of interstitial spaces between the load bearing strands; and (b) a conduit disposed within the plurality of load bearing strands, the conduit having a length and adapted to permit a performance-enhancing compound to flow therethrough, the conduit having a seam extending along the length of the conduit, the seam permitting a predetermined portion of the performance-enhancing compound to effuse outwardly through the seam and into contact with the plurality of load bearing strands.

2. The wire rope of claim 1, wherein the seam includes overlapping portion and a layer of elastomeric material disposed around the seam to permit an even outflow of performance-enhancing compound from the tube.

3. The wire rope of claim 2, wherein the overlapping portions of the tube form a helical seam extending the length of the tube to permit a predetermined portion of the perfornance-enhancing compound to pass through the helical seam.

4. The wire rope of claim 1, wherein the performance-enhancing compound is a lubricant.

5. The wire rope of claim 1, wherein the performance-enhancing compound is a lubricant with a yield shear of greater than zero.

6. A method of lubricating a wire rope, comprising the steps of:

(a) injecting a performance-enhancing compound into the wire rope, wherein the wire rope includes a plurality of strands wrapped around an axis and a first conduit disposed within the plurality of strands, wherein the first conduit is a strand of material wound to form a tube, the tube having an exterior surface, an interior surface and a plurality of seams extending between the exterior and interior surfaces; and (b) allowing the performance-enhancing compound to exude from the first conduit through the plurality of seams to lubricate the plurality of strands.

7. The method of claim 6, wherein the performance-enhancing compound is a lubricant with a yield shear of at least zero.

8. The method of claim 6, wherein the performance-enhancing compound is a lubricant with a yield shear of greater than zero.

* * * * *

UNITED STATES PATENT AND TRADEMARK OFFICE

CERTIFICATE OF CORRECTION

PATENT NO. : 6,474,057 B2 
DATED : November 5, 2002
INVENTOR(S) : G.J. Bertini et al.

It is certified that error appears in the above-identified patent and that said Letters Patent is hereby corrected as shown below:

Column 8,
Line 37, "from the tube." should read -- from the conduit. --
Lines 39 and 40, "of the tube" should read -- of the conduit --
Line 41, "perfornance-enhancing" should read -- performance-enhancing --

Signed and Sealed this

Twenty-sixth Day of August, 2003

JAMES E. ROGAN
*Director of the United States Patent and Trademark Office*